US012065295B2

(12) United States Patent
Migas et al.

(10) Patent No.: US 12,065,295 B2
(45) Date of Patent: Aug. 20, 2024

(54) ONE-PIECE CLOSURE

(71) Applicant: Closure Systems International Inc., Indianapolis, IN (US)

(72) Inventors: Jeremiah Migas, Crawfordsville, IN (US); Jeremy Morin, Zionsville, IN (US)

(73) Assignee: Closure Systems International Inc., Indianapolis, IN (US)

( * ) Notice: Subject to any disclaimer, the term of this patent is extended or adjusted under 35 U.S.C. 154(b) by 0 days.

(21) Appl. No.: 17/850,353

(22) Filed: Jun. 27, 2022

(65) Prior Publication Data

US 2023/0055070 A1 Feb. 23, 2023

Related U.S. Application Data

(60) Provisional application No. 63/260,422, filed on Aug. 19, 2021.

(51) Int. Cl.
*B65D 51/22* (2006.01)
*B65D 1/02* (2006.01)

(52) U.S. Cl.
CPC ..... *B65D 51/228* (2013.01); *B65D 1/0246* (2013.01); *B65D 2251/0021* (2013.01); *B65D 2251/0093* (2013.01)

(58) Field of Classification Search
CPC ..... B65D 2401/30; B65D 41/0421; B65D 51/228; B65D 1/0246; B65D 2251/0021; B65D 2251/0093
USPC ..... 220/258.2, 270; 222/153.07, 541.9; 215/43, 47, 48, 250, 255, 256, 258, 44, 215/45; 22/153.06
See application file for complete search history.

(56) References Cited

U.S. PATENT DOCUMENTS

| | | | |
|---|---|---|---|
| 2,423,582 | A | 7/1947 | Coleman |
| 3,160,327 | A | 12/1964 | Porcelli |
| 3,199,702 | A | 8/1965 | Fischbach |
| 3,282,477 | A | 11/1966 | Henchert |
| 3,415,403 | A | 12/1968 | Bardell |
| 3,667,638 | A | 6/1972 | Cambio, Jr. |

(Continued)

FOREIGN PATENT DOCUMENTS

| | | | |
|---|---|---|---|
| EP | 0 008 190 | A1 | 2/1980 |
| GB | 1 052 734 | A | 12/1966 |

(Continued)

*Primary Examiner* — Steven A. Reynolds
*Assistant Examiner* — Prince Pal
(74) *Attorney, Agent, or Firm* — Nixon Peabody LLP

(57) ABSTRACT

A one-piece polymeric closure includes first and second closure portions. The first closure portion includes a first polymeric top wall portion and a first polymeric annular skirt portion. The first annular skirt includes a first set of splines on an inner surface thereof and knurls formed on an exterior surface thereof. The second closure portion includes a second polymeric top wall portion with a pull ring and a second polymeric annular skirt portion The second annular skirt portion includes a second set of splines on an outer surface thereof, an internal thread formation, and a locking ratchet band. The first and second sets of splines are configured to interact with each other when the polymeric closure is in a closed position. The polymeric closure opens by flipping the first closure portion with respect to the second closure portion via a hinge.

20 Claims, 11 Drawing Sheets

(56) References Cited

U.S. PATENT DOCUMENTS 3,795,338 A * 3/1974 Swartzbaugh ..... B65D 50/041 215/301
3,797,688 A * 3/1974 Porcelli ..... B65D 50/041 215/220
3,904,061 A 9/1975 Keeler
4,022,357 A * 5/1977 Dwinell ..... B65D 47/147 222/541.9
RE29,850 E 11/1978 Labarre
4,171,749 A 10/1979 Obrist
4,180,175 A 12/1979 Virog
4,301,937 A * 11/1981 Von Hagel ..... B65D 41/0414 215/44
4,345,690 A 8/1982 Hopley
4,345,691 A 8/1982 Burke
4,418,828 A 12/1983 Wilde
4,423,820 A 1/1984 Vangor
4,458,822 A 7/1984 Ostrowsky
4,470,513 A 9/1984 Ostrowsky
4,497,765 A 2/1985 Wilde
4,505,401 A 3/1985 Berglund
4,506,795 A 3/1985 Herr
4,533,062 A 8/1985 Krautkramer
4,534,480 A 8/1985 Santostasi
4,550,844 A 11/1985 Lininger
4,562,931 A 1/1986 Brach
4,573,601 A 3/1986 Berglund
4,592,476 A 6/1986 Yasada
4,609,115 A 9/1986 Moore
4,630,743 A 12/1986 Wright
4,635,808 A 1/1987 Nolan
4,638,917 A 1/1987 Persch
4,682,702 A * 7/1987 Gach ..... B65D 51/20 222/541.9
4,813,561 A 3/1989 Ochs
4,818,828 A 4/1989 Curley
4,938,370 A 7/1990 McBride
4,971,212 A 11/1990 Kusz
4,978,017 A 12/1990 McBride
4,993,570 A 2/1991 Julian
4,997,097 A 3/1991 Krautkramer
5,050,753 A 9/1991 Trump
5,133,486 A * 7/1992 Moore ..... B65D 47/103 229/125.05
5,167,335 A 12/1992 McBride
5,190,177 A 3/1993 Collins
5,205,426 A 4/1993 McBride
5,301,849 A 4/1994 Guglielmini
5,307,946 A 5/1994 Molinaro
5,314,085 A 5/1994 Bonet
5,328,044 A 7/1994 Rohrs
5,346,082 A 9/1994 Ochs
5,356,021 A 10/1994 McBride
5,450,972 A 9/1995 Zemlo
5,480,045 A 1/1996 Molinaro
5,484,101 A * 1/1996 Hedberg ..... B65D 5/746 220/255
5,501,349 A 3/1996 McCandless
5,564,582 A 10/1996 Kamath
5,588,545 A 12/1996 King
5,715,959 A 2/1998 Pfefferkorn
5,735,426 A * 4/1998 Babcock ..... B65D 5/746 215/354
5,755,360 A 5/1998 Elliott
5,782,369 A 7/1998 Tansey
5,785,209 A 7/1998 Guglielmini
5,797,506 A 8/1998 Lehmkuhl
5,800,764 A 9/1998 Smeyak
5,810,207 A 9/1998 Hayashida
5,829,611 A 11/1998 Beck
5,833,112 A * 11/1998 Pape ..... B65D 5/748 222/541.6
5,860,542 A 1/1999 Takamatsu
5,875,942 A 3/1999 Ohmi
5,915,574 A 6/1999 Adams
5,915,579 A 6/1999 Przytulla
5,934,496 A * 8/1999 Mogard ..... B65D 47/103 220/837
5,950,850 A 9/1999 Takamatsu
6,006,930 A 12/1999 Dreyer
6,016,931 A 1/2000 Ohmi
6,044,992 A 4/2000 Ma
6,056,136 A 5/2000 Taber
6,085,921 A 7/2000 Brown
6,089,390 A 7/2000 Druitt
6,109,465 A 8/2000 Henning
6,112,923 A 9/2000 Ma
6,116,440 A * 9/2000 Zaksenberg ..... B65D 11/04 215/354
6,116,445 A 9/2000 Ikemori
6,125,610 A * 10/2000 Mogard ..... B65B 61/186 493/379
6,202,872 B1 3/2001 Smeyak
6,247,605 B1 6/2001 Fujie
6,276,543 B1 8/2001 German
6,325,225 B1 12/2001 Druitt
6,371,316 B1 * 4/2002 Herr ..... B65D 55/024 215/253
6,371,317 B1 4/2002 Krueger
6,390,342 B1 * 5/2002 Mabee ..... B65D 47/103 222/541.9
6,484,896 B2 11/2002 Ma
6,491,175 B1 * 12/2002 Taha ..... B65D 41/0442 215/354
6,527,132 B1 * 3/2003 Druitt ..... B65D 41/0428 215/DIG. 1
6,557,714 B2 5/2003 Babcock
6,574,848 B2 6/2003 Fujie
6,673,298 B2 1/2004 Krueger
6,685,049 B1 * 2/2004 Paladino ..... B65D 25/205 220/780
6,705,479 B2 3/2004 Druitt
6,776,314 B2 8/2004 Odet
6,779,672 B2 8/2004 Kano
6,793,101 B2 9/2004 Shinozaki
6,991,123 B2 1/2006 Druitt
7,014,055 B2 3/2006 Kano
D530,603 S 10/2006 Lohrman
7,128,227 B2 * 10/2006 Skillin ..... B65D 47/0809 215/44
7,204,389 B2 * 4/2007 Smith ..... B65D 43/0212
D547,184 S 7/2007 Kim
7,308,988 B2 12/2007 Yashima
7,344,039 B2 3/2008 Bixler
7,451,898 B2 11/2008 Seidita
D588,915 S 3/2009 Lohrman
7,503,468 B2 3/2009 Druitt
7,559,432 B2 * 7/2009 Mavin ..... B65D 51/20 222/541.9
7,607,547 B2 10/2009 Kumata
7,637,384 B2 12/2009 Price
D608,199 S 1/2010 Gross
D610,454 S 2/2010 Lohrman
D626,410 S * 11/2010 Lohrman ..... D9/438
7,832,579 B2 * 11/2010 Lohrman ..... B65D 47/36 215/256
7,861,873 B1 * 1/2011 Bragg ..... B65D 50/046 220/254.5
7,942,287 B2 5/2011 King
7,975,864 B2 7/2011 Druitt
8,302,794 B2 * 11/2012 Russell ..... B65D 41/3423 215/258
8,807,360 B2 8/2014 Erspamer
9,598,209 B1 * 3/2017 Maldonado ..... B65D 47/122
9,963,274 B2 * 5/2018 Brunner ..... B65D 41/50
10,138,043 B2 * 11/2018 Mazurkiewicz ... B65D 47/0857
10,173,816 B2 * 1/2019 Danks ..... B65D 5/746
D847,633 S 5/2019 Berge
10,414,560 B1 * 9/2019 Aryanpanah ..... A61J 1/03
D871,904 S 1/2020 Berge
D871,905 S 1/2020 Kim
10,875,689 B2 * 12/2020 Sanguinet ..... B65D 41/46
10,913,583 B2 * 2/2021 Sanguinet ..... B65D 17/4012

(56) References Cited

U.S. PATENT DOCUMENTS

2001/0011649 A1 8/2001 Fujie
2001/0015355 A1 8/2001 Adams
2001/0027957 A1 10/2001 Kano
2002/0030031 A1 3/2002 Druitt
2002/0066713 A1 6/2002 Ma
2002/0134747 A1 9/2002 Babcock
2003/0071042 A1* 4/2003 Adams ..... B65D 47/103 222/541.9
2003/0116523 A1 6/2003 Druitt
2003/0136753 A1* 7/2003 Biesecker ..... B65D 51/243 215/206
2004/0060893 A1 4/2004 Kano
2004/0065665 A1 4/2004 Mahdi
2004/0118846 A1* 6/2004 Merolla ..... B65D 47/08 220/254.2
2004/0155007 A1 8/2004 Hearld
2004/0217083 A1* 11/2004 Mavin ..... B65D 47/103 215/253
2004/0238478 A1 12/2004 Druitt
2005/0092750 A1* 5/2005 Lohrman ..... B65D 47/36 215/254
2005/0189312 A1 9/2005 Bixler
2005/0205618 A1* 9/2005 Mabee ..... B65D 47/0814 222/541.9
2006/0000793 A1* 1/2006 Mavin ..... B65D 47/103 222/153.07
2006/0163193 A1 7/2006 Smeyak
2007/0125785 A1 6/2007 Robinson
2007/0131641 A1 6/2007 Higgins
2008/0073313 A1* 3/2008 Brant ..... B65D 41/04 215/329
2008/0078765 A1* 4/2008 Steiger ..... B65D 47/0804 220/345.1
2008/0078775 A1* 4/2008 Steiger ..... B65D 51/20 220/361
2008/0087625 A1 4/2008 Kumata
2008/0110848 A1* 5/2008 Lantos ..... B65D 51/226 215/313
2008/0173611 A1* 7/2008 Neputy ..... B65D 41/3423 215/256
2009/0014404 A1* 1/2009 Russell ..... B65D 50/041 215/220
2009/0159555 A1 6/2009 Druitt
2010/0140268 A1* 6/2010 Lohrman ..... B65D 47/103 220/270
2011/0006031 A1* 1/2011 Antier ..... B65D 47/0861 215/250
2011/0011821 A1 1/2011 Lohrman
2011/0174761 A1* 7/2011 Molinaro ..... G10L 15/1815 215/256
2011/0290754 A1* 12/2011 Taber ..... B65D 41/04 215/329
2012/0080442 A1* 4/2012 Groubert ..... B65D 53/02 220/849
2012/0248133 A1* 10/2012 Danks ..... B65D 47/0838 220/849
2012/0318798 A1* 12/2012 Domoy ..... B65D 43/169 220/258.2
2013/0026126 A1* 1/2013 Adamczak ..... B65D 50/041 215/219
2014/0021157 A1* 1/2014 Gren ..... B65D 41/0421 215/252
2014/0263149 A1* 9/2014 Berge ..... B65D 41/3423 215/44
2014/0263335 A1* 9/2014 Taber ..... B65D 41/0421 220/276
2015/0217910 A1* 8/2015 Vogel ..... B65D 47/40 222/111
2015/0225106 A1* 8/2015 Mayer ..... B65D 1/0246 215/44
2015/0272197 A1* 10/2015 Swain ..... B65D 1/02 426/115
2015/0353241 A1* 12/2015 Glaser ..... B65D 55/02 53/476
2016/0023819 A1* 1/2016 Maldonado ..... B65D 47/103 222/541.9
2016/0176590 A1* 6/2016 Prater ..... B65D 85/70 215/44
2016/0184182 A1* 6/2016 Gross ..... B65D 51/18 215/316
2016/0355306 A1* 12/2016 Robin ..... B65D 17/4012
2017/0096273 A1* 4/2017 Mazurkiewicz ... B65D 75/5883
2020/0156829 A1* 5/2020 Pristera ..... B65D 41/3428
2022/0002021 A1* 1/2022 Krautkramer ..... B65D 5/748
2022/0242625 A1* 8/2022 Schmidt ..... B65D 47/2006
2022/0332474 A1* 10/2022 Cahalan ..... B65D 43/16

FOREIGN PATENT DOCUMENTS

GB 1 054 308 A 1/1967
GB 2 068 912 A 8/1980
GB 1 593 072 7/1981
GB 2 311 060 A 9/1997
JP 2011-114313 A 6/2011
WO WO 2002/076839 A2 10/2002

* cited by examiner

ONE-PIECE CLOSURE

CROSS-REFERENCE TO RELATED APPLICATIONS

This application claims priority to and benefit of U.S. Provisional Patent Application No. 63/260,422 filed Aug. 19, 2021, which is hereby incorporated by reference herein in its entirety.

FIELD OF THE INVENTION

The present invention relates generally to a polymeric closure for a package. More specifically, the present invention relates to a one-piece, hinged polymeric closure that assists in transferring torque.

BACKGROUND OF THE INVENTION

Polymeric closures have been used in many applications over the years in conjunction with containers. One type of polymeric closure that has been used with containers is a tamper-evident polymeric closure. Tamper-evident closures are used to prevent or inhibit tampering by providing a visible indication to a user if the closure has been opened. One drawback of tamper-evident closures being separated into two individual components is that the top portion may not be recycled along with the remainder of the closure and container. This scenario raises potential environmental concerns with so many containers having tamper-evident features on its closures that can be separated into two individual components.

Additionally, a problem exists with the ability of lighter weight polymeric closures to transfer and distribute torque (both top load and rotational torque) in an efficient manner. This torque is provided during the manufacturing process when the closure is being placed on the container.

It would be desirable to provide a one-piece closure that overcomes such problems, while still performing desirable properties of a closure including having tamper-evident features.

SUMMARY

According to one embodiment, a one-piece polymeric closure includes a first closure portion and a second closure portion. The first closure portion includes a first polymeric top wall portion, and a first polymeric annular skirt portion depending from the first polymeric top wall portion. The first polymeric annular skirt portion includes a first set of splines on an inner surface thereof. The first polymeric annular skirt portion includes a plurality of knurls formed on an exterior surface thereof. The second closure portion includes a second polymeric top wall portion including a removable pull ring, and a second polymeric annular skirt portion depending from the second polymeric top wall portion. The second polymeric annular skirt portion includes a second set of splines on an outer surface thereof, an internal thread formation for mating engagement with an external thread formation of a container, and a locking ratchet band to assist in preventing or inhibiting access to the container. The first and second sets of splines are configured and located to interact with each other when the polymeric closure is in a closed position. The polymeric closure is adapted to be opened by flipping the first closure portion with respect to the second closure portion via a hinge.

According to another embodiment, a package includes a container and a one-piece closure. The container has a neck portion defining an opening. The container has an external thread formation on the neck portion. The one-piece closure is configured for fitment to the neck portion of the container for closing the opening. The one-piece closure includes a first closure portion and a second closure portion. The first closure portion includes a first polymeric top wall portion, and a first polymeric annular skirt portion depending from the first polymeric top wall portion. The first polymeric annular skirt includes a first set of splines on an inner surface thereof. The first polymeric annular skirt portion includes a plurality of knurls formed on an exterior surface thereof. The second closure portion includes a second polymeric top wall portion including a removable pull ring, and a second polymeric annular skirt portion depending from the second polymeric top wall portion. The second polymeric annular skirt portion includes a second set of splines on an outer surface thereof, an internal thread formation for mating engagement with an external thread formation of a container, and a locking ratchet band to assist in preventing or inhibiting access to the container. The first and second sets of splines are configured and located to interact with each other when the polymeric closure is in a closed position. The polymeric closure is adapted to be opened by flipping the first closure portion with respect to the second closure portion via a hinge.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which:

FIG. 2D is an enlarged view of the first set of splines according to one embodiment.

FIG. 2E is an enlarged view of the second set of splines according to one embodiment.

Figure 1A:
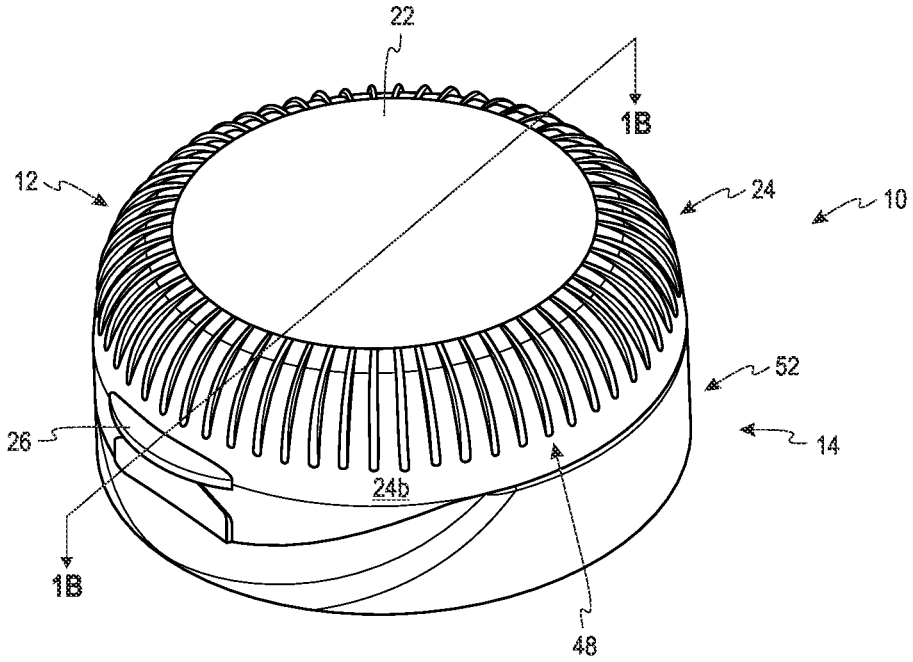
FIG. 1A is a top perspective view of a closure in a closed or unopened position according to one embodiment.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Figure 1B:
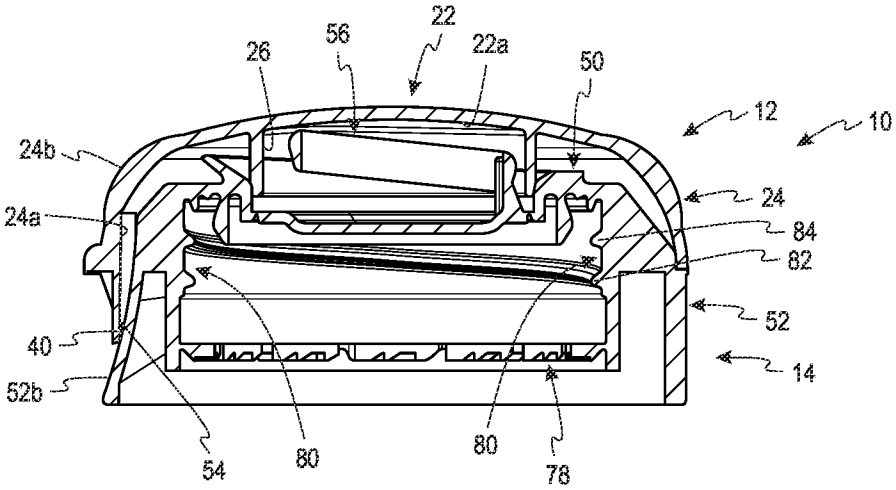
FIG. 1B is a cross-sectional view of the closure of FIG. 1A taken generally across line 1B-1B of FIG. 1A in a closed position.
Figure 1C:
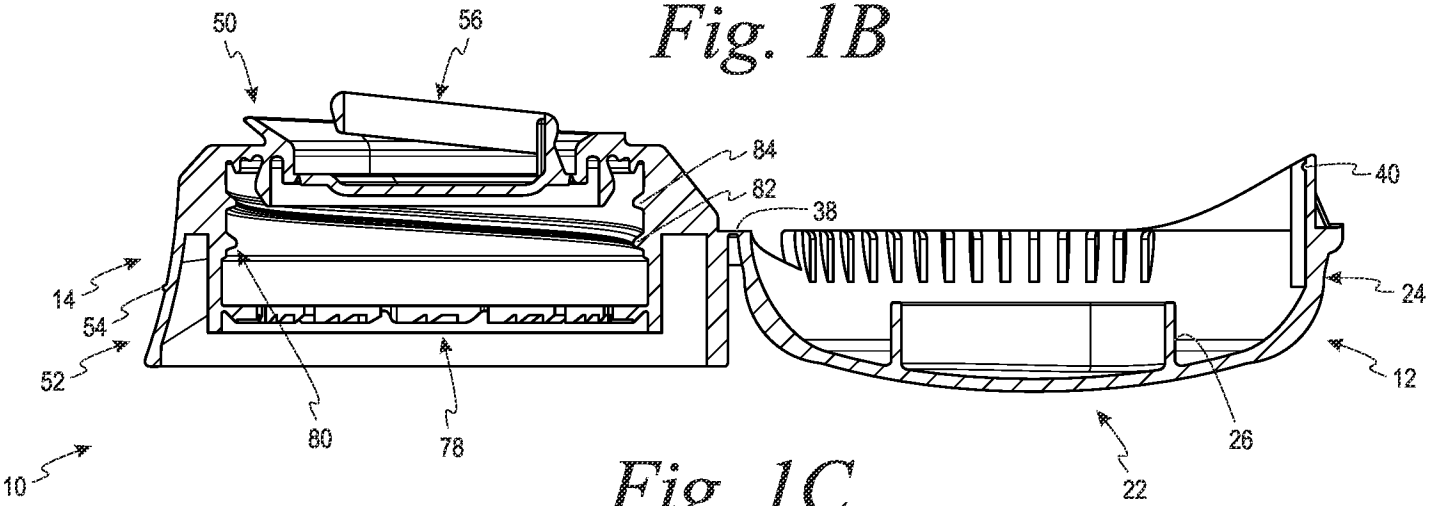
FIG. 1C is a cross-sectional view of the closure of FIG. 1A in an open position.

FIGS. 1A-1C illustrate a one-piece polymeric closure 10 according to one embodiment. FIG. 1A illustrates the one-piece polymeric closure 10 in a closed position. FIGS. 1B and 1C are cross-sectional views in a closed position and an open position of the polymeric closure 10, respectively. The polymeric closure 10 of FIG. 1 is generally cylindrically shaped. The one-piece polymeric closures of the present invention are configured to be placed on a container or bottle that contain product. The one-piece polymeric closure is desirably lightweight.

Figure 2A:
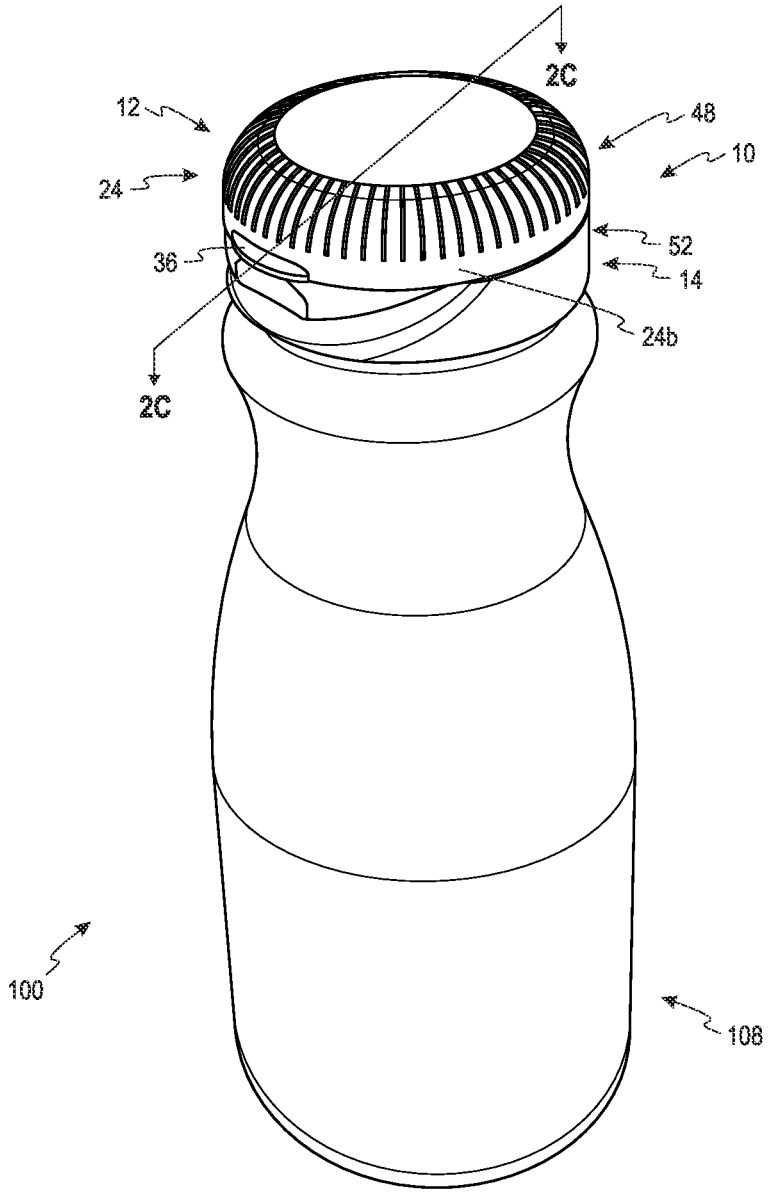
FIG. 2A is a top perspective view of the closure of FIG. 1A and a container in a closed position according to one embodiment.
Figure 2B:
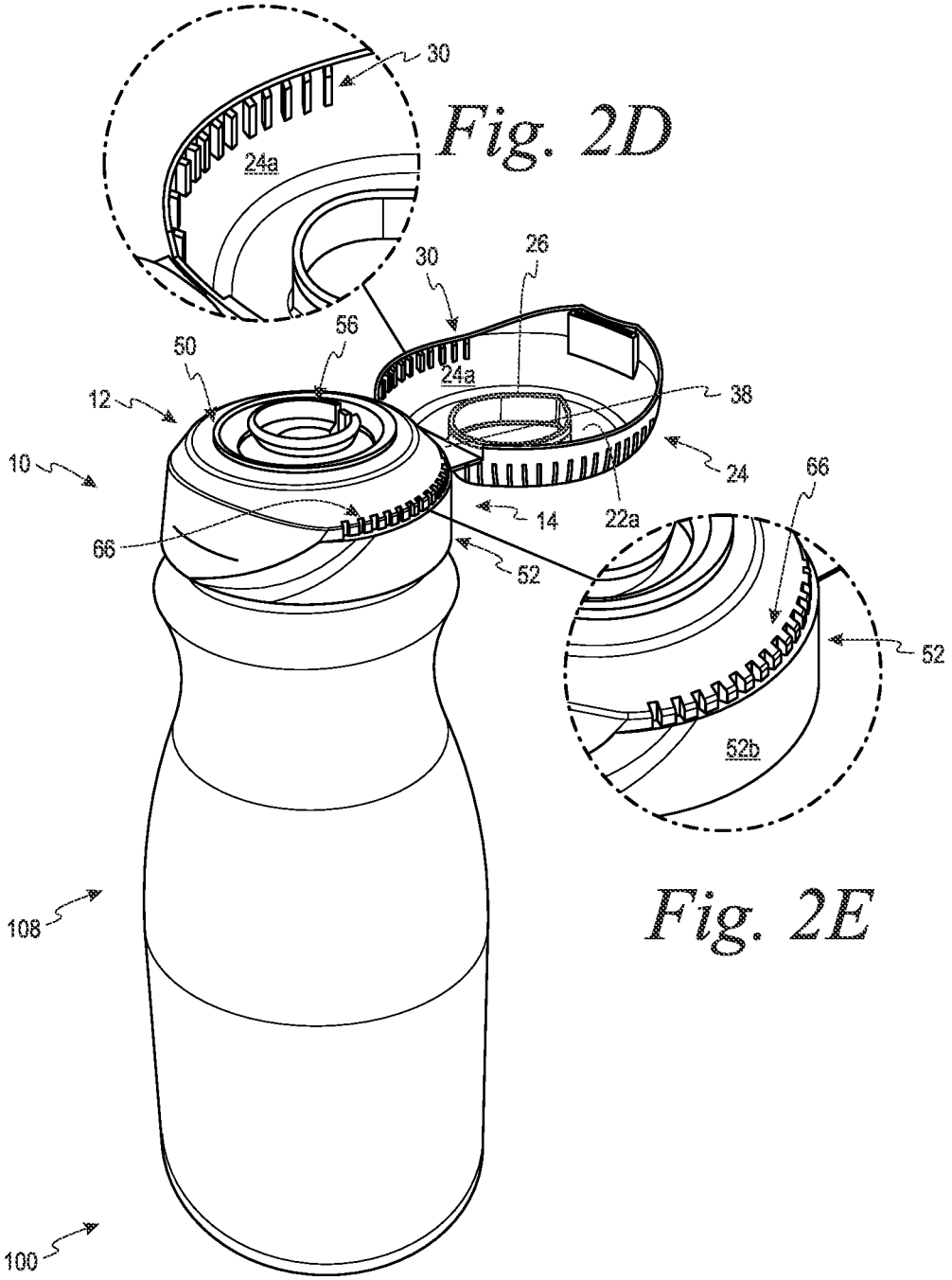
FIG. 2B is a top perspective view of the closure of FIG. 1A and the container of FIG. 2A in an open position.
Figure 2C:
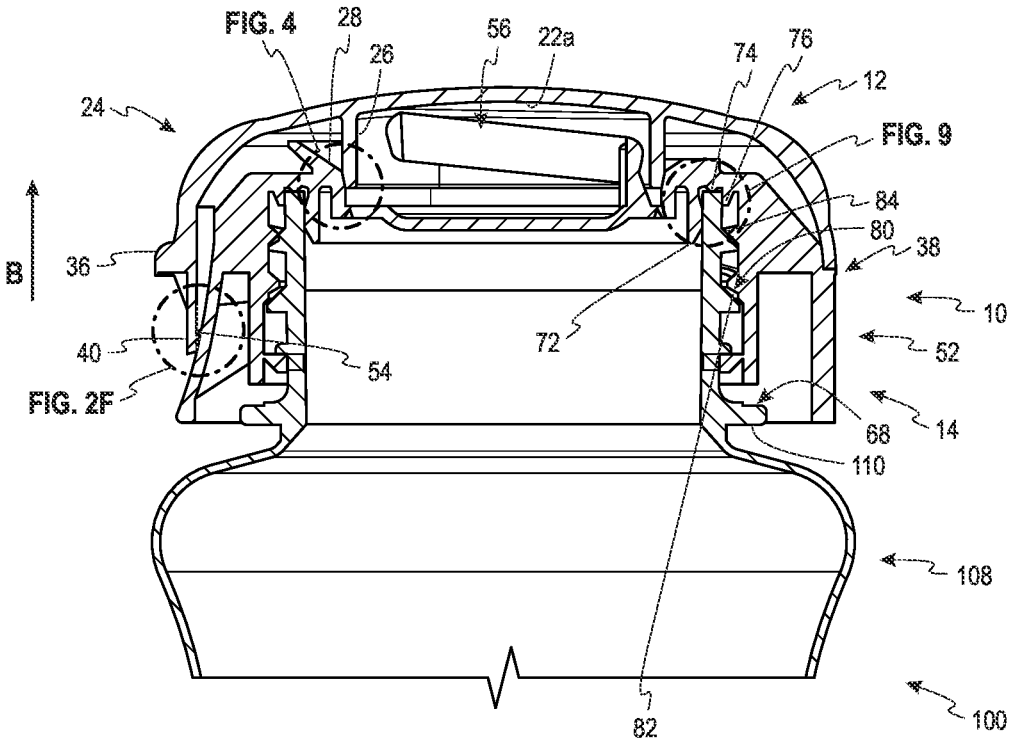
FIG. 2C is a cross-sectional view of the closure of FIG. 1A and the container of FIG. 2A taken generally across line 2C-2C of FIG. 2A.

FIGS. 2A-2C illustrate a package 100 including the one-piece polymeric closure 10 and a container 108 according to one embodiment of the present invention. FIG. 2A shows the package 100 having the polymeric closure 10 in a closed position, while FIG. 2B shows the package 100 having the polymeric closure 10 in an open position. FIG. 2C shows a cross-sectional view of the package 100 taken generally along line 2C-2C of FIG. 2A with the polymeric closure 10 in a closed position. The product is typically a liquid product, but also may be a solid product or a combination of a liquid and solid product. The one-piece polymeric closure is configured to remain with the container so as to reduce environmental waste.

Referring back to FIGS. 1A-1C, the one-piece polymeric closure 10 includes a first closure portion or lid 12 and a second closure portion or base 14. The first closure portion 12 and the second closure portion 14 are adapted to be flipped with respect to each other via a hinge 38 as will be discussed in detail below. The first closure portion 12 includes a first polymeric top wall portion 22 and a first polymeric annular skirt portion 24. The first polymeric annular skirt portion 24 depends from the first polymeric top wall portion 22. As shown best in FIG. 1C, the second closure portion 14 includes a second polymeric top wall portion 50 and a second polymeric annular skirt portion 52. The second polymeric annular skirt portion 52 depends from the second polymeric top wall portion 50.

Figure 4:
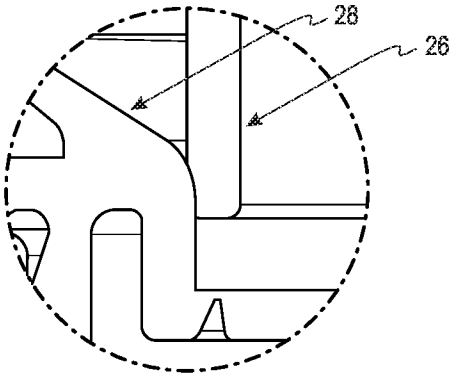
FIG. 4 is an enlarged cross-sectional view taken from generally circular area FIG. 4 in FIG. 2C depicting a continuous wedge seal according to one embodiment.

Referring to FIGS. 1B, 2C and 4, the first polymeric top wall portion 22 includes a continuous wedge seal 26 extending from an inner surface 22*a* thereof according to one embodiment. The continuous wedge seal 26 works in conjunction with a slanted extension 28 of the second closure portion 14 to form a continuous wedge seal (see FIG. 4). The continuous wedge seal 26 and the slanted extension 28 provide sealing to prevent or inhibit air or moisture from reaching the contents of the container 108 after a removable pull ring 56 is removed, which will be discussed below with respect to FIGS. 7A-7C. The continuous wedge seal 26 is sized and located such that a sufficient seal is formed with the slanted extension 28 of the second closure portion 14.

Figure 3:
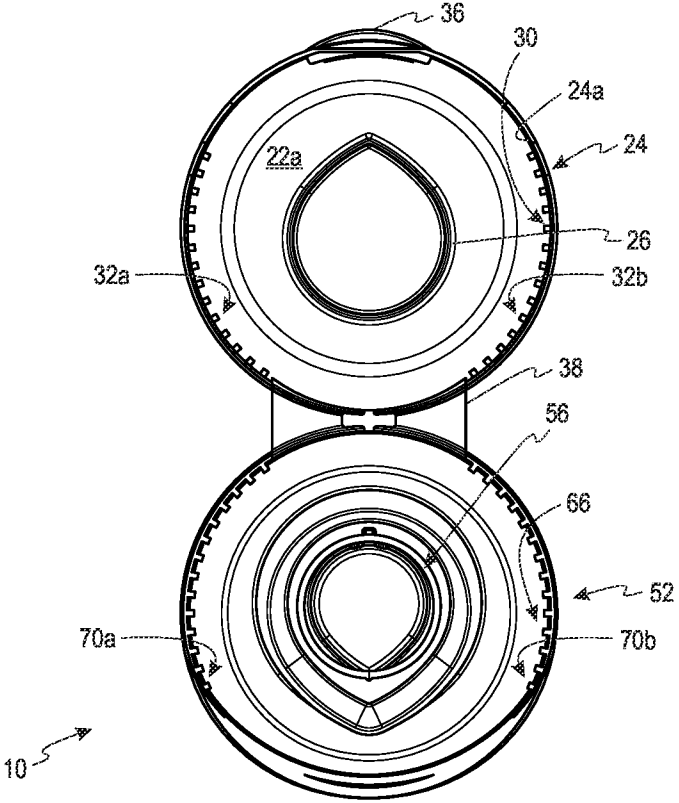
FIG. 3 is a top view of the closure of FIG. 1A in an open position.

Referring to FIGS. 2B, 2D and 3, the first polymeric annular skirt 24 includes a first set of splines 30 formed on an inner surface 24*a* thereof. As will be discussed below, the first set of splines 30 assists in the torque transfer as the polymeric closure 10 is being applied onto the container 108. Specifically, in the first polymeric annular skirt 24, the first set of splines 30 is located in two different areas 32*a*, 32*b* (FIG. 3) on an inner surface 24*a* thereof. It is contemplated that the first set of splines may be formed in a continuous manner on an inner surface of the first polymeric annular skirt portion.

It is contemplated that the first set of splines may be formed in additional inner surfaces areas than depicted in FIG. 3. It is contemplated that the first set of splines may extend generally around an inner surface of the first polymeric annular skirt portion. It is contemplated that the splines may extend substantially around an inner surface of the first polymeric annular skirt portion in another embodiment, or even entirely around an inner surface of the first polymeric annular skirt portion in a further embodiment.

To assist a user in opening the first closure portion 12 with respect to the second closure portion 14, the first polymeric annular skirt portion 24 includes a lift extension 36 as shown in FIGS. 2A, 2C. The lift extension 36 of FIGS. 2A, 2C is shaped and sized for a user to grasp when opening the polymeric closure 10. The lift extension 36 is generally located opposite of the hinge 38.

Figure 2F:
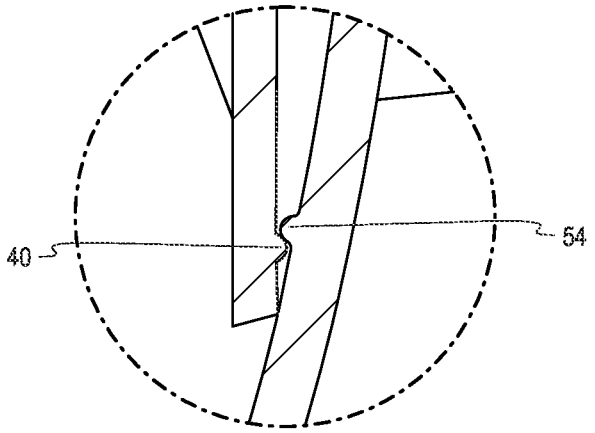
FIG. 2F is an enlarged view of the interlocking beads according to one embodiment.

Referring to FIGS. 1B and 2F, the first polymeric annular skirt portion 24 includes a first interlocking bead 40 extending from an inner surface 24*a* thereof. The second polymeric annular skirt portion 52 includes a second interlocking bead 54 extending from an outer surface 52*b* thereof. The first and second interlocking beads 40, 54 cooperate to assist in maintaining the polymeric closure 10 in a closed position.

Referring to FIGS. 1A and 2A, the first polymeric annular skirt portion 24 includes a plurality of knurls 48 formed on an exterior surface 24*b* thereof. In one embodiment, the plurality of knurls 48 is compatible and cooperates with a gripper chuck. The gripper chuck (not shown) provides a top load and a rotational load onto the closure when placing a closure onto a container. The plurality of knurls 48 aligns with the inside of the gripper chuck and assists in providing a balanced load onto the closure in one embodiment.

Figure 5:
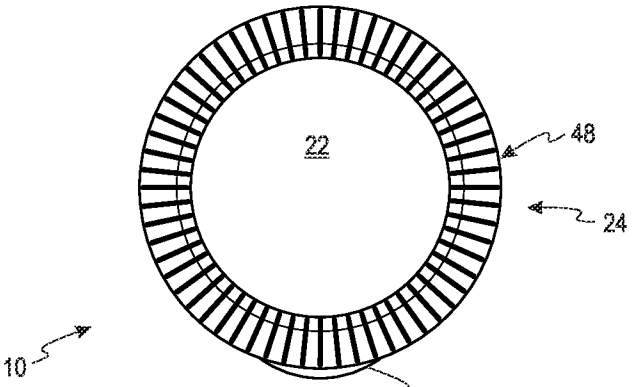
FIG. 5 is a top view of the closure of FIG. 1A in a closed position.

The plurality of knurls 48 extends around the entire periphery of the first annular skirt portion 24 as best shown in FIG. 5. It is contemplated that the plurality of knurls may extend around less than the entire periphery of the first polymeric annular skirt portion. In one embodiment, the plurality of knurls extends generally around the first polymeric annular skirt portion. In another embodiment, the plurality of knurls extends substantially around the first polymeric annular skirt portion. It is contemplated that the size and shape of the knurls may be shaped and sized differently than shown in FIG. 5. The knurls, however, should be desirably configured for compatibility to a gripper chuck.

Figure 6:
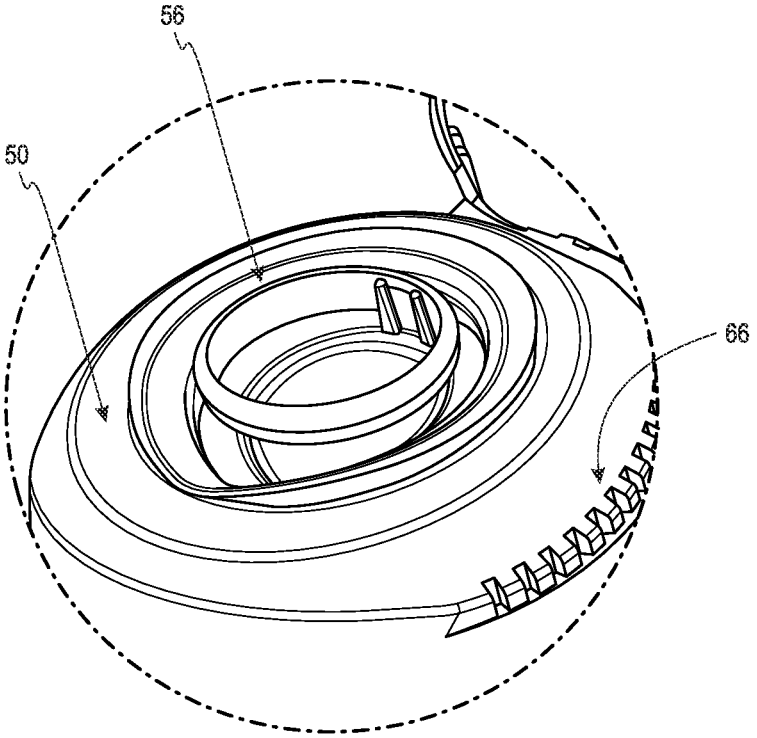
FIG. 6 is an enlarged top perspective view of a removable pull ring according to one embodiment.

Referring back to FIGS. 2A-2C, the second closure portion 14 includes the second polymeric top wall portion 50 and the second polymeric annular skirt portion 52. The second polymeric top wall portion 50 includes the removable pull ring 56. The removable pull ring 56 is a tamper-evident feature in the polymeric closure 10. A top view of the removable pull ring 56 is shown in its initial position in the polymeric closure 10 in FIG. 3. An enlarged top perspective view of the removable pull ring 56 is shown in FIG. 6. The removable pull ring 56 is configured to be removed such that a user may gain access to the contents of the container 108.

Figure 7A:
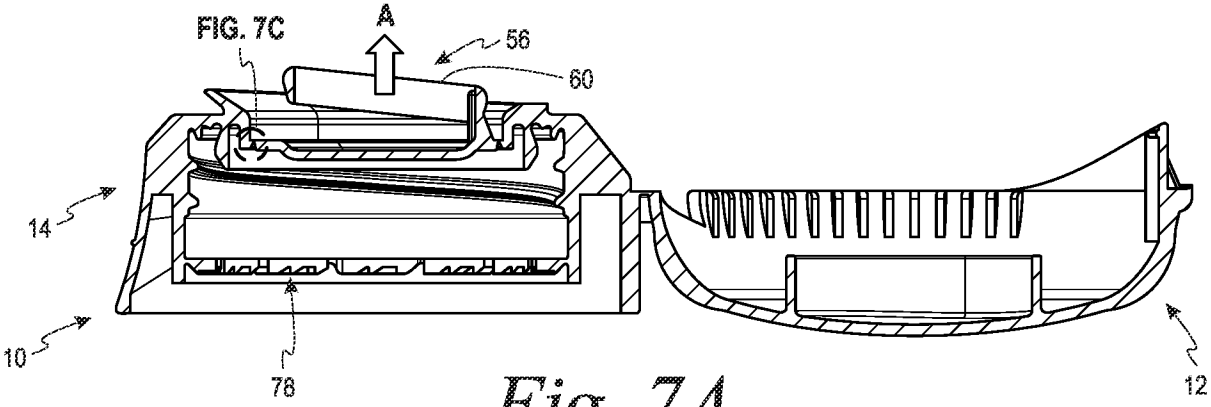
FIG. 7A is a cross-sectional view of the closure of FIG. 1A taken generally across line 1B-1B of FIG. 1A in an open position before a pull ring has been removed.
Figure 7B:
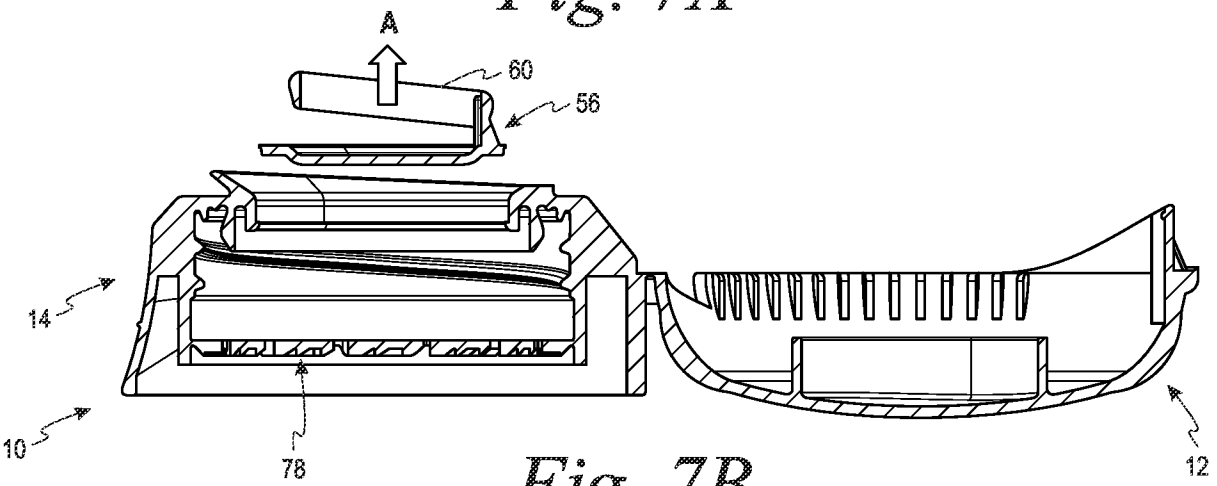
FIG. 7B is a cross-sectional view of the closure of FIG. 1A taken generally across line 1B-1B of FIG. 1A in an open position after the pull ring has been removed.
Figure 7C:
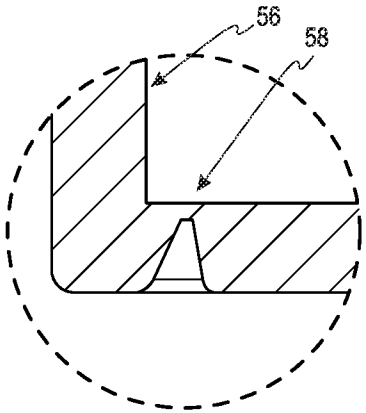
FIG. 7C is an enlarged cross-sectional view of the generally circular area FIG. 7C in FIG. 7A showing a thinned tearable section according to one embodiment.

Referring to FIGS. 7A-7C, the removable pull ring 56 is configured to be removed from the remainder of the closure 10 in this embodiment by its perimeter that includes a thinned tearable section 58. The thinned tearable section 58 generally has from about 5 to about 30 percent of the thickness of the remainder of the removable pull ring 56. This assists the user in removing the removable pull ring 56 without an undue force, while still preventing or inhibiting inadvertent removal of the removable pull ring 56. To remove the pull ring, a user grasps the removable pull ring 56 (see FIG. 7A), and more specifically, grasps a ring portion 60 of the removable pull ring 56. After grasping the ring portion 60, the user pulls in the general direction of Arrow A with sufficient force to break the thinned tearable section 58 that extends around the perimeter of the removable pull ring 56. FIG. 7B depicts the polymeric closure 10 after the removable pull ring 56 has been removed from the polymeric closure 10.

Figure 8:
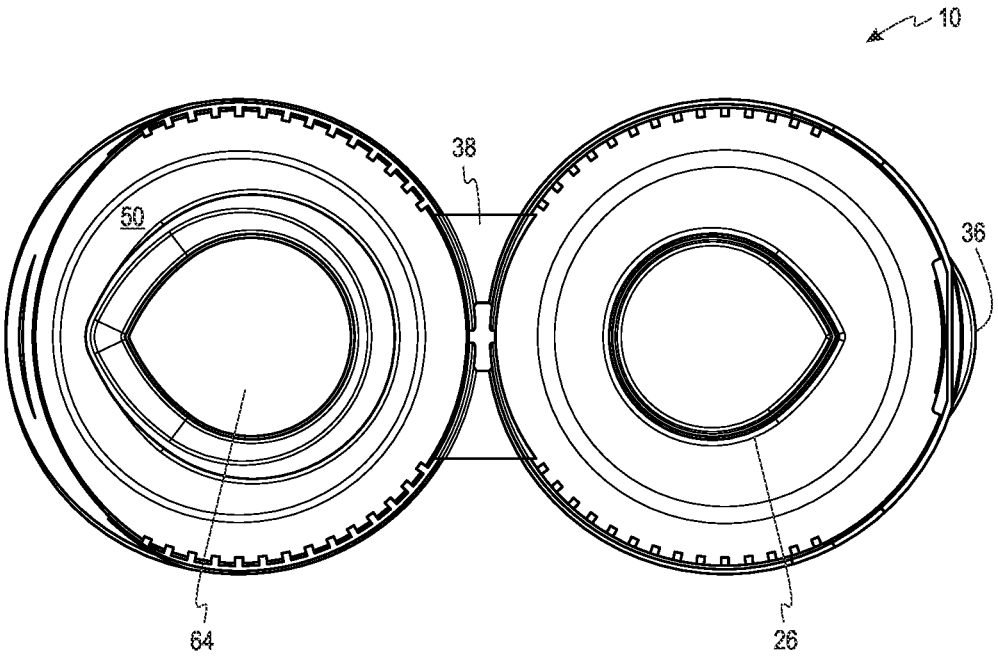
FIG. 8 is a top perspective view of the closure of FIG. 1A in an open position after the removable pull ring has been removed.

In one embodiment, as shown in FIG. 8, a polymeric closure 10 without the removable pull ring 56 is shown. After the removable pull ring 56 is removed, an opening 64 in the second polymeric top wall portion 50 is formed. This opening 64 allows a user to gain access to the contents of the container 108. The shape of the opening 64 of FIG. 8 is generally tear-dropped. This shape, for example, assists a user in allowing the contents to be smoothly and controllable poured or accessed from the container. It is contemplated that the shape and size of the opening formed by the removal of the removable pull tab may be different from that depicted in FIG. 8.

Figure 10A:
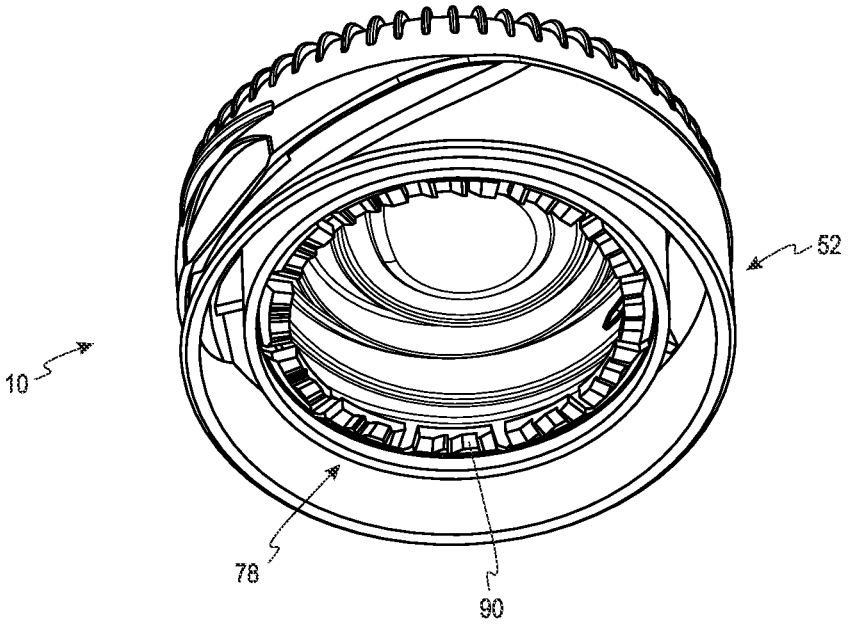
FIG. 10A is a bottom perspective view of the closure of FIG. 1A.
Figure 10B:
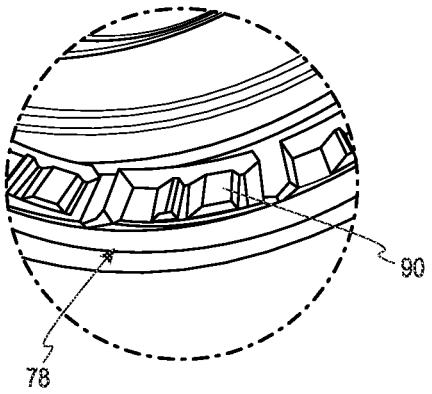
FIG. 10B is an enlarged bottom perspective view of a locking ratchet band according to one embodiment.

The second polymeric annular skirt portion 52 includes a second set of splines 66 on an outer surface 52*b* thereof (see FIGS. 2E and 3), an internal thread formation 80 for mating engagement with an external thread formation of a container (see FIGS. 1C and 2C), and a locking ratchet band 78 to assist in preventing or inhibiting access to the container (see FIGS. 1C, 10A, 10B).

The second set of splines 66 is located in two different areas 70*a*, 70*b* on the outer surface 52*b* of the second polymeric annular skirt portion 52 as best shown in FIGS. 2E and 3. A portion of the second set of splines 66 is shown in FIGS. 2B, 2E. It is contemplated that the second set of splines may be formed in a continuous manner on an outer surface of the second polymeric annular skirt portion.

It is contemplated that the second set of splines may be formed in additional outer surfaces areas than depicted in FIG. 3. It is contemplated that the second set of splines may extend generally around an outer surface of the second polymeric annular skirt portion. It is contemplated that the splines may extend substantially around an outer surface of the second polymeric annular skirt portion in another embodiment, or even entirely around an outer surface of the second polymeric annular skirt portion in a further embodiment.

The first and second sets of splines 30, 66 are configured and located to interact with each other when the polymeric closure 10 is in a closed position. The first and second sets of splines 30, 66 assist in the torque transfer as the polymeric closure 10 is being applied onto the container 108. Specifically, during the manufacturing process of threading the polymeric closure 10 onto the container 108, the gripper chuck provides torque transfer to the closures as discussed above. The first and second sets of splines 30, 66 assist in transferring these torque transfer (top load and rotational load) through the polymeric closure 10 and onto the container 108.

In this regard and referring back to FIG. 2C, the second polymeric annular skirt portion 52 forms an undercut 68 that corresponds and receives a transfer collar 110 of the container 108. The undercut 68 and the transfer collar 110 are in an abutting relationship with each other. The undercut 68 and the transfer collar 110 assist in transferring and distributing the loads applied by the gripper chuck.

Figure 9:
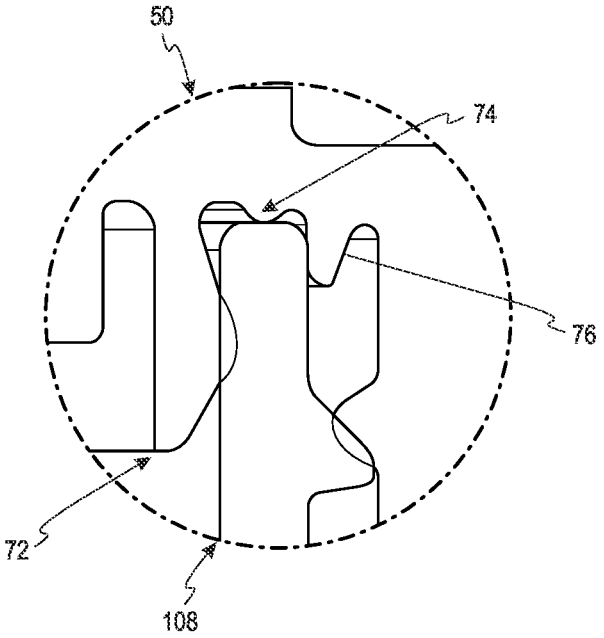
FIG. 9 is an enlarged cross-sectional view taken from generally circular area FIG. 9 in FIG. 2C depicting a sealing area according to one embodiment.

Referring still to FIG. 2C, the second closure portion 14 further includes a polymeric continuous plug seal 72, a top seal 74 and an outer seal 76. As shown in FIGS. 2C and 9, the polymeric continuous plug seal 72, a top seal 74 and the outer seal 76 depend from the second polymeric top wall portion 50, and provide a sealing mechanism. The continuous plug seal 72 of FIG. 9 provides an inner seal with an inner finish surface of the container 108. The top seal 74 provides a top seal with respect to an outer top finish surface of the container 108. The outer seal 76 provides an outer seal with respect to an outer finish surface of the container 108.

In another embodiment, the polymeric closure may include other sealing mechanisms. For example, the closure may include only a polymeric outer seal and a continuous plug seal. It is contemplated that the polymeric closure may include other sealing mechanisms.

Referring to FIGS. 1B and 2C, the second polymeric annular skirt portion 52 includes an internal thread formation 80 for mating engagement with an external thread formation of a container. The internal thread formation 80 includes a first closure lead 82 and a second closure lead 84. The first and second closure leads 82, 84 are referred collectively as a double lead closure thread. Each of the first and second closure leads 82, 84 is continuous. The first positions of the first and second closure leads 82, 84 may be located roughly 180 degrees apart from each other and, thus, begin on generally opposing sides of the closure 10.

It is contemplated that the first and second closure leads may be discontinuous. It is also contemplated that the internal thread formation of the closure may differ from a helical thread formation. It is also contemplated that other internal thread formations may be used in the closure. For example, the internal thread formation may include a triple-threaded structure having first, second and third closure leads.

Figure 11:
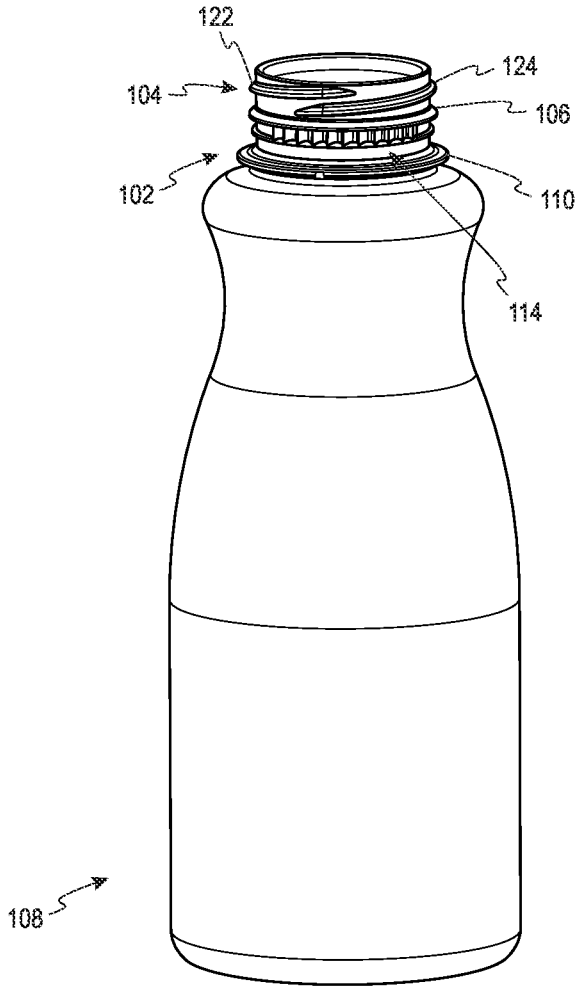
FIG. 11 is a generally side perspective view of the container of FIG. 2A in the absence of a closure according to one embodiment.

The second polymeric annular skirt portion 52 includes the locking ratchet band 78 that includes a plurality of teeth 90, which is shown in the molded state in FIGS. 10A, 10B. The locking ratchet band 78 works in conjunction with finish ratchet teeth 114 of the container 108, which are shown in FIG. 11. Specifically, the plurality of teeth 90 of the locking ratchet band 78 folds up and ratchets onto the finish ratchet teeth 114 of the container 108 during application of the closure 10 onto the container 108, which creates an irreversible lock. Thus, a user cannot unscrew the polymeric closure 10 from the finish of the container 108 to gain access to the contents of the container.

Thus, the locking ratchet band 78 and the finish ratchet teeth 114 form a tamper-evident feature that prevents or inhibits a user from gaining access to the contents of the container 108 by attempting to unscrew the polymeric closure 10 with respect to the container 108.

One non-limiting example of a polymeric closure and a container forming a package is shown and previously discussed in conjunction with FIGS. 2A-2C. FIGS. 2A-2C depict the closure 10 and the container 108 forming the package 100. The container 108 is also shown in FIG. 11. The container 108 of FIG. 11 includes a neck portion 102 that defines an opening. The neck portion 102 of the container 108 includes an external thread formation 104, an A-collar 106, and the transfer collar 110. The A-collar 106 prevents or inhibits the polymeric closure 10 from being lifting upwardly and away from the container 108.

The external thread formation 104 includes a first finish lead 122 and a second finish lead 124. The external thread formation 104 (finish leads 122, 124) engages with the corresponding internal thread formation 80 (closure leads 82, 84) (FIG. 2C) to seal the package 100. The first and second finish leads 122, 124 may extend in a helical fashion such as shown in FIG. 11. Each of the first and second finish leads 122, 124 is discontinuous.

In another embodiment, the first positions of the first and second finish leads are located roughly 180 degrees apart from each other and, thus, begin on opposing sides of the neck portion of the container. When opening the container, a first closure lead is desirably in contact with the first finish lead and the second closure lead is desirably in contact with the second finish lead. It is contemplated that the external thread formation of the container may have discontinuous leads. It is contemplated that the external thread formation of the container may be different than depicted in FIG. 11.

The closures of the present invention may include an oxygen-scavenger material. This oxygen-scavenger material may be distributed within the closure or may be a separate layer. The oxygen-scavenger material may be any material that assists in removing oxygen within the container, while having little or no effect on the contents within the container.

Alternatively, or in addition to, the closures may include an oxygen-barrier material. The oxygen-barrier material may be added as a separate layer or may be integrated within the closure itself. The oxygen-barrier materials assist in preventing or inhibiting oxygen from entering the container through the closure. These materials may include, but are not limited to, ethylene vinyl alcohol (EVOH). It is contemplated that other oxygen-barrier materials may be used in the closure.

Additionally, it is contemplated that other features may be included in the closure described above. For example, U.S. Publication No. 2017/0349336, U.S. Pat. Nos. 9,126,726, 8,763,830, 8,485,374, U.S. Publication No. 2009/0045158 and U.S. Pat. No. 6,123,212 all include features that could be incorporated in the closures of the present invention. All of these references are hereby incorporated by reference in their entireties.

The polymeric closure 10 is typically made of an polyolefin (e.g., polyethylene (PE), polypropylene (PP)) or blends thereof. One example of a polyethylene that may be used is high density polyethylene (HDPE), low density polyethylene (LDPE) or the combination thereof. It is contemplated that the closure may be made of other polymeric materials.

The polymeric closure is typically light weight. The polymeric closure is generally from about 8 to about 30 grams and typically is from about 8 to about 20 grams. In other embodiments, the polymeric closure is from about 10 to about 17 grams, or from about 12 to about 17 grams. The polymeric closure in a further embodiment is from about 8 to about 15 grams, or from about 10 to about 15 grams.

The polymeric closures are typically formed by processes such as injection or compression molding.

The container 108 is typically made of polymeric material. One non-limiting example of a material to be used in forming a polymeric container is polyethylene terephthalate (PET), polypropylene (PP) or blends using the same. It is contemplated that the container may be formed of other polymeric or copolymer materials. It is also contemplated that the container may be formed of glass. The container 108 typically has an encapsulated oxygen-barrier layer or oxygen barrier material incorporated therein.

In one method to open the container 108 and gain access to the product therein, the first closure portion 12 is initially flipped with respect to the second closure portion 14 using the hinge 38. Referring to FIG. 2C, a user will grasp the lift extension 36 and pull upwardly (in the direction of Arrow B). This will break the contact of the interlocking beads 40, 54, which is not very strong, and allows the first closure portion 12 to slip past the second closure portion 14. FIG. 2B depicts the polymeric closure 10 and the container 108 after the flipping has been completed. It is desirable for the first closure portion 12 to flip or rotate at least about 125 degrees or even more desirably at least 135 or at least 150 degrees from a closed position to an open position until being locked.

The hinge 38 as shown best in FIG. 3 is continuous and is one integral component. It is contemplated that the hinge may be a plurality of hinges to assist in moving the first closure portion and the second closure portion with respect to each other.

The tamper-evident features may be modified in other embodiments. For example, the polymeric closure may include at least one frangible connection instead of a locking ratchet band. The at least one frangible connection is in the form of scoring or scored lines, notches, leaders, nicks or other lines of weaknesses. In this embodiment, the remaining features of the polymeric closure may be present. The at least one frangible connection would be a tamper-evident feature. The container to be used with this closure would not include finish ratchet teeth. In one method, the at least one frangible connection is formed by a slitting technology that is independent from the formation of the remainder of the polymeric closure.

The polymeric closures of the present invention are desirable in both low-temperature and high-temperature applications. The polymeric closures may be used in low-temperature applications such as an ambient or a cold fill. These applications include aseptic applications such as dairy products, water, sports drinks, and pressurized products such as carbonated soft drinks. It is contemplated that other low-temperature applications may be used with the polymeric closures formed by the processes of the present invention.

The polymeric closures of the present invention may be exposed to high-temperature applications such as hot-fill, pasteurization, and retort applications. A hot fill application is generally performed at temperatures around 185° F., while a hot-fill with pasteurization is generally performed at temperatures around 205° F. Retort applications are typically done at temperatures greater than 250° F. It is contemplated that the polymeric closures of the present invention can be used in other high-temperature applications.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A one-piece polymeric closure comprising:

a first closure portion including:

a first polymeric top wall portion, a first polymeric annular skirt portion depending from the first polymeric top wall portion, the first polymeric annular skirt portion including a first set of splines on an inner surface thereof, the first polymeric annular skirt portion including a plurality of knurls formed on an exterior surface thereof; and a second closure portion including:

a second polymeric top wall portion including a removable pull ring, a second polymeric annular skirt portion depending from the second polymeric top wall portion, the second polymeric annular skirt portion including a second set of splines on an outer surface thereof, an internal thread formation for mating engagement with an external thread formation of a container, and a locking ratchet band to assist in preventing or inhibiting access to the container, the first and second sets of splines being configured and located to interact with each other when the polymeric closure is in a closed position and to assist in torque transfer when the polymeric closure is being applied onto a container, wherein the polymeric closure is adapted to be opened by flipping the first closure portion with respect to the second closure portion via a hinge.

2. The closure of claim 1, wherein the plurality of knurls extends around the entire periphery of the first polymeric annular skirt portion.

3. The closure of claim 1, wherein the second closure portion further includes a polymeric continuous plug seal depending from the second polymeric top wall portion.

4. The closure of claim 3, wherein the second closure portion further includes an outer seal depending from the second polymeric top wall portion.

5. The closure of claim 1, wherein the first polymeric top wall portion includes a continuous wedge seal extending from an inner surface thereof.

6. The closure of claim 1, wherein the first polymeric annular skirt portion includes a lift extension to assist in moving the first closure portion with respect to the second closure portion, the lift extension being generally located opposite of the hinge.

7. The closure of claim 1, wherein the first polymeric annular skirt portion includes a first interlocking bead extending from an inner surface thereof, the second polymeric annular skirt portion including a second interlocking bead extending from an outer surface thereof, the first and second interlocking beads cooperate to assist in maintaining the polymeric closure in a closed position.

8. The closure of claim 1, wherein the closure comprises at least one polyolefin.

9. The closure of claim 1, wherein the closure weighs from about 8 to about 20 grams.

10. The closure of claim 9, wherein the closure weighs from about 10 to about 15 grams.

11. A package comprising:

a container having a neck portion defining an opening, the container having an external thread formation on the neck portion; and a one-piece closure being configured for fitment to the neck portion of the container for closing the opening, the one-piece closure including a first closure portion and a second closure portion, the first closure portion including a first polymeric top wall portion, and a first polymeric annular skirt portion depending from the first polymeric top wall portion, the first polymeric annular skirt including a first set of splines on an inner surface thereof, the first annular skirt portion including a plurality of knurls formed on an exterior surface thereof; the second closure portion including: a second polymeric top wall portion including a removable pull ring, and a second polymeric annular skirt portion depending from the second polymeric top wall portion, the second polymeric annular skirt portion including a second set of splines on an outer surface thereof, an internal thread formation for mating engagement with an external thread formation of the container, and a locking ratchet band to assist in preventing or inhibiting access to the container, the first and second sets of splines being configured and located to interact with each other when the polymeric closure is in a closed position and to assist in torque transfer when the polymeric closure is being applied onto the container, wherein the polymeric closure is adapted to be opened by flipping the first closure portion with respect to the second closure portion via a hinge.

12. The package of claim 11, wherein the container further includes a transfer collar, the one-piece closure further includes an undercut formed on the second polymeric annular skirt portion, the transfer collar and the undercut cooperating to assist in distributing the torque during application of the closure onto the container.

13. The package of claim 11, wherein the container further includes finish ratchet teeth, the finish ratchet teeth cooperate with the locking ratchet band to provide an irreversible lock.

14. The package of claim 11, wherein the plurality of knurls extends around the entire periphery of the first polymeric annular skirt portion.

15. The package of claim 11, wherein the first polymeric top wall portion includes a continuous wedge seal extending from an inner surface thereof.

16. The package of claim 11, wherein the first polymeric annular skirt portion includes a lift extension to assist in moving the first closure portion with respect to the second closure portion, the lift extension being generally located opposite of the hinge.

17. The package of claim 11, wherein the first polymeric annular skirt portion includes a first interlocking bead extending from an inner surface thereof, the second polymeric annular skirt portion including a second interlocking bead extending from an outer surface thereof, the first and second interlocking beads cooperate to assist in maintaining the polymeric closure in a closed position.

18. The package of claim 11, wherein the closure comprises at least one polyolefin.

19. The package of claim 11, wherein the closure weighs from about 8 to about 20 grams.

20. The package of claim 19, wherein the closure weighs from about 10 to about 15 grams.

* * * * *